US006145363A

United States Patent [19]

Farina

[11] Patent Number: 6,145,363

[45] Date of Patent: Nov. 14, 2000

[54] FORMING MACHINE FOR METAL STRIPS, IN PARTICULAR FOR THE MANUFACTURE OF PLATES FOR ELECTRICS ACCUMULATORS

[75] Inventor: Pietro Farina, Villafranca, Italy

[73] Assignee: Sovema S.R.L., Villafranca, Italy

[21] Appl. No.: 09/157,562

[22] Filed: Sep. 21, 1998

[30] Foreign Application Priority Data

Jun. 18, 1998 [IT] Italy ..... VR98A0056

[51] Int. Cl.[7] ..... B21D 31/04

[52] U.S. Cl. ..... 72/186; 29/6.1

[58] Field of Search ..... 72/184, 190, 186; 83/321, 327, 328; 29/6.1, 6.2

[56] References Cited

U.S. PATENT DOCUMENTS 2,192,707 3/1940 Grupe ..... 83/321
4,102,024 7/1978 Badger et al. ..... 29/6.2

*Primary Examiner*—Lowell A. Larson
*Attorney, Agent, or Firm*—Browdy And Neimark

[57] ABSTRACT

Forming machine for metal strips, in particular for the manufacture of plates for electric accumulators, comprising moving means (2, 3) designed to convey a continuous strip (10) through an incision zone (8) associated with forming means (7) provided with a plurality of teeth (9) operationally actuated by actuator means (11) so as to make incisions in the strip (10) so as to form a continuous mesh (12). The actuator means (11) move the forming means (7) in accordance with a law of motion having a component oriented in the direction of feeding (A) of the strip (10) and a component oriented in a direction (B) substantially perpendicular to the direction of feeding (A) of the strip (10). The first component allows the teeth (9) to advance substantially in synchronism with the strip (10), while the second component allows the teeth (9) to make incisions in and expand the strip (10) during an incision step of the machine (1). For this purpose, the strip is fed continuously by the moving means (2, 3).

16 Claims, 5 Drawing Sheets

FORMING MACHINE FOR METAL STRIPS, IN PARTICULAR FOR THE MANUFACTURE OF PLATES FOR ELECTRICS ACCUMULATORS

BACKGROUND OF THE INVENTION

1. Field of the Invention

The present invention relates to a forming machine for metal strips, in particular for the manufacture of plates for electric accumulators.

The machine in question may be advantageously used for the production of a continuous lead grid from which it is possible to obtain, by means of cutting operations, the plates to be inserted in the electric accumulators.

2. Description of the Prior Art

At present, in accordance with the known art, the machines intended for forming of the grids use a feeding system which is capable of feeding, in successive steps, a lead strip through a die provided with teeth for production of the meshes of the grids, which make up the plates.

As is known, in these machines, the strip stops in the forming zone so as to undergo incision by the teeth, which are generally actuated by moving means coupled to the feeding system, following which it advances by a predetermined amount so as to allow forming of a successive section of strip.

In practice, certain operational drawbacks have been associated with the forming machines realized hitherto. Firstly, the discontinuous feeding system does not allow the forming machines to reach high levels of productivity, this being due to the fact that stepwise feeding of the lead strip is obviously subject to the mechanical strength limits of the lead.

Secondly, the forming machines of the known type do not allow the production of grids of a high qualitative standard. This is due in particular to the stepwise movement of the lead strip resulting from the discontinuous feeding system. In fact, it gives rise to numerous inaccuracies with regard to correct positioning of the strip in the forming zone owing to the continuous stoppage and restarting thereof. The production of the grids resulting therefrom is distinguished by a lack of uniformity in the distribution of the meshes which give the grids a somewhat irregular appearance.

SUMMARY OF THE INVENTION

The main object of the present invention is therefore that of overcoming the drawbacks associated with the machines of the known type, by providing a forming machine for metal strips, in particular for the manufacture of plates for electric accumulators, which allows high levels of productivity to be achieved, while maintaining a high qualitative standard.

A further object of the present invention is that of providing a constructionally simple and operationally very reliable machine.

BRIEF DESCRIPTION OF THE DRAWINGS

The technical characteristics of the invention, in accordance with the aforementioned objects, may be clearly understood from the contents of the claims indicated below, and the advantages thereof will emerge more clearly from the detailed description which follows, provided with reference to the accompanying drawings illustrating a purely exemplary and non-limiting embodiment thereof, in which:

DETAILED DESCRIPTION OF THE PREFERRED EMBODIMENTS

With reference to the accompanying drawings, 1 denotes in its entirety the forming machine for metal strips according to the present invention.

Below, particular reference will be made to a example of embodiment relating to a forming machine 1 for a lead strip 10 for the manufacture of plates for electric accumulators.

Figure 1:
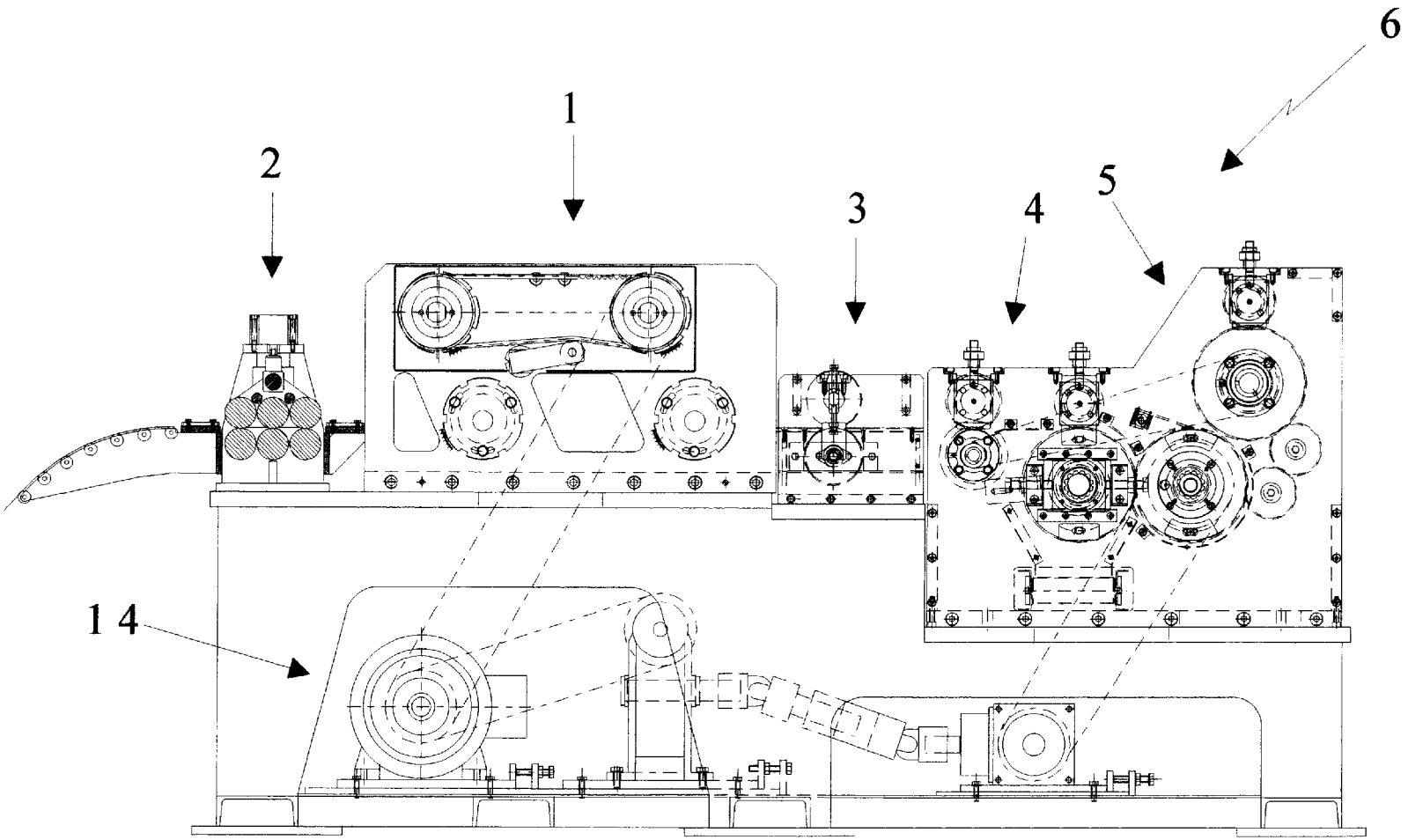
FIG. 1 shows in schematic form a production line for plates for electric accumulators, within which the forming machine in question is operationally inserted.
Figure 2:
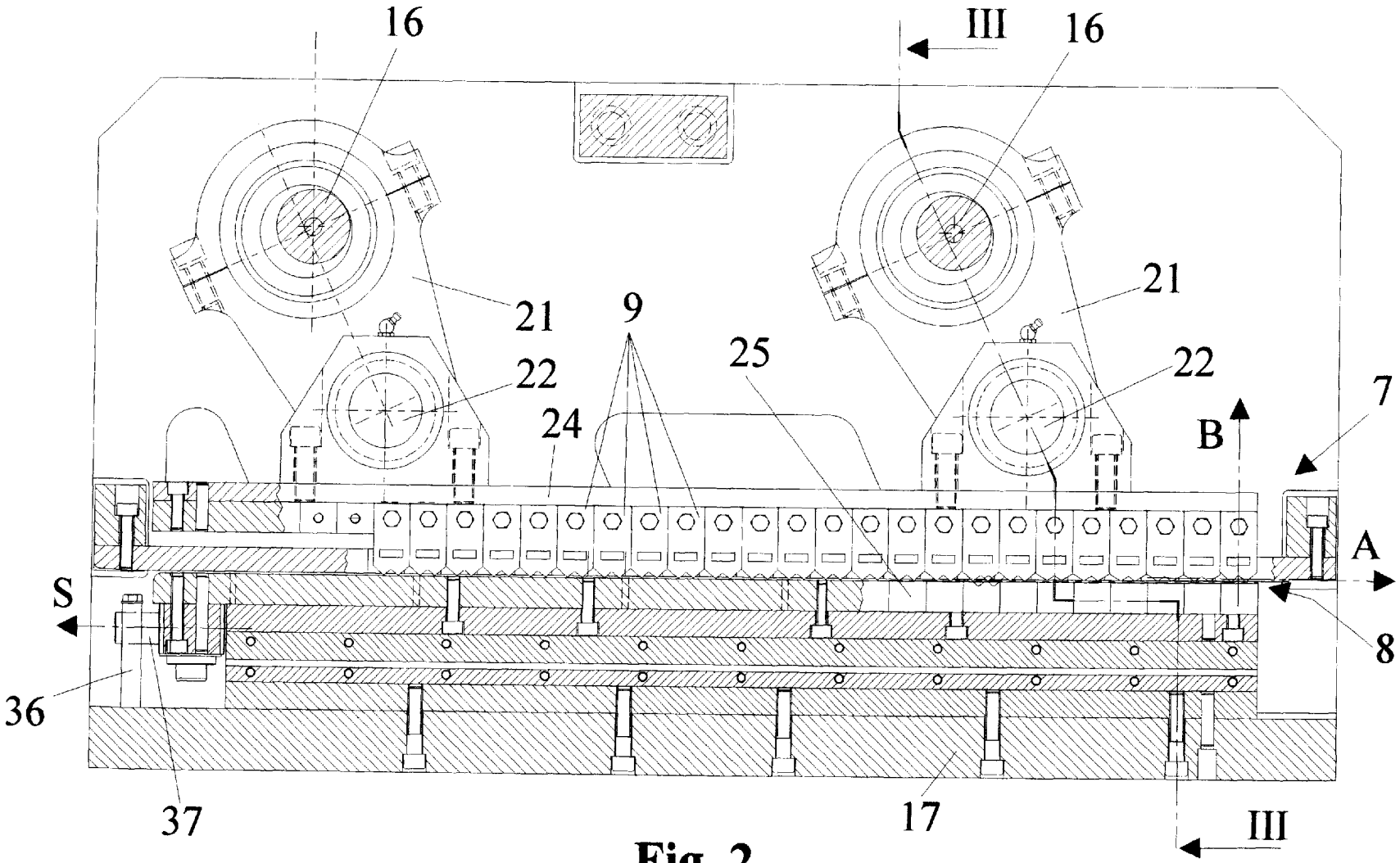
FIG. 2 shows in schematic form a side view of the machine, with some parts sectioned and others removed, so as to reveal more clearly other parts.

Said machine is operationally arranged between a feeding group 2 arranged upstream and a traction group 3 arranged downstream. Advantageously, along the same line for production of lead plates, at the exit from the traction group, a group 4 for leveling the grids and a group 5 for cutting the lugs may also be provided. In this way the manufacture of lead grids may be obtained by means of a single, very compact, production assembly 6 shown in FIG. 1.

Figure 4:
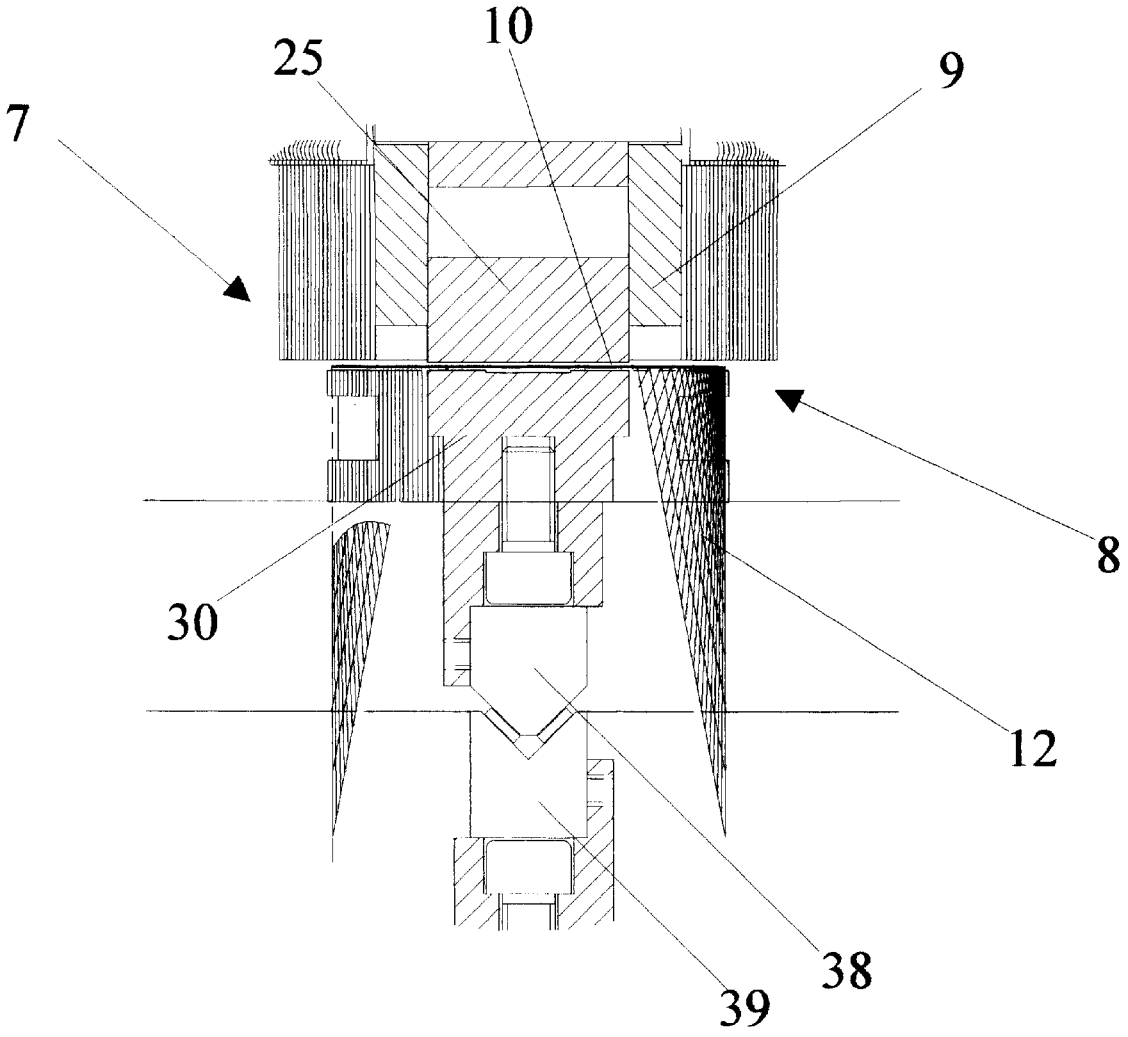
FIG. 4 shows an enlarged detail of FIG. 3 relating to the forming zone.

The machine 1 in question comprises essentially forming means 7 associated with an incision zone 8 of the machine 1 and provided with a plurality of teeth 9 which are operationally actuated by actuator means 11 so as to make incisions in the lead strip 10 and expand it transversely with respect to its direction of feeding A, thereby forming a continuous lead meshwork 12 as schematically shown in FIG. 4.

The actuator means 11, which will be described in detail below, move the forming parts 7 via a transmission and support structure 13 in accordance with a law of motion having a component oriented in the direction of feeding A of the strip 10 and a component oriented in a direction B substantially perpendicular to the direction of feeding A of the strip 10.

Owing to the said first component of motion, the teeth 9 are able to advance during an incision step of the machine 1 substantially in synchronism with the strip 10, while, owing to the said second component, which is perpendicular to the first one, the teeth are able to make incisions in and expand the continuous strip 10.

Figure 5B:
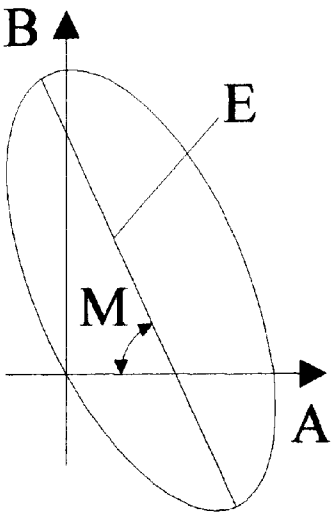
FIG. 5*b* shows in schematic form part of the kinematic movement corresponding to the law of motion of FIG. 5*a* which allows the rotary movement of a motor to be converted into a movement with an elliptical trajectory of the teeth.

In particular with reference to FIG. 5*b*, the abovementioned incision step must be understood as substantially corresponding to the section of the curve with negative ordinates.

Feeding of the strip 10 to the incision zone 8 occurs continuously owing to the action of the feeding group 2 and the traction group 3.

The abovementioned actuator means 11 comprise a motor 14 which is able to cause rotation, via a flexible transmission means 15, of an eccentric shaft 16 which transmits the movement to the transmission and support structure 13 which supports the forming means 7.

The same structure 13 is moreover connected to the machine body 17 by means of connecting means 18 which, as will be explained below, cooperate to produce the law of motion.

More in detail, the motor causes rotation, about an axis X, of the eccentric shaft 16 which engages onto a collar 20 and causes it to rotate about an axis $X_1$.

The collar 20 is connected to the forming means 7 by means of the transmission and support structure 13. For this purpose the latter is composed, in the case of the example of embodiment shown in the accompanying figures, of two columns 21 between which there is fixed a second shaft 22 rotatably supporting about its axis P a frame 23 on which the forming means 7 are mounted.

Functionally speaking, when the transmission and support structure 13 transmit the movement of the eccentric shaft 16 to the forming means 7, the teeth 9 remain always arranged parallel to one another owing to rotation of the frame about the second shaft 22.

The teeth 9 are organized in rows arranged symmetrically with respect to a center plane V on a plate 24 integral with the frame 23.

Moreover, advantageously the teeth 9 have, arranged between them, a part-separating element 25 which is integral with the machine body 17 and the operational function of which consists in its capacity to separate the edges of the formed lead plates 12 from the surfaces of the teeth 9.

Figure 3:
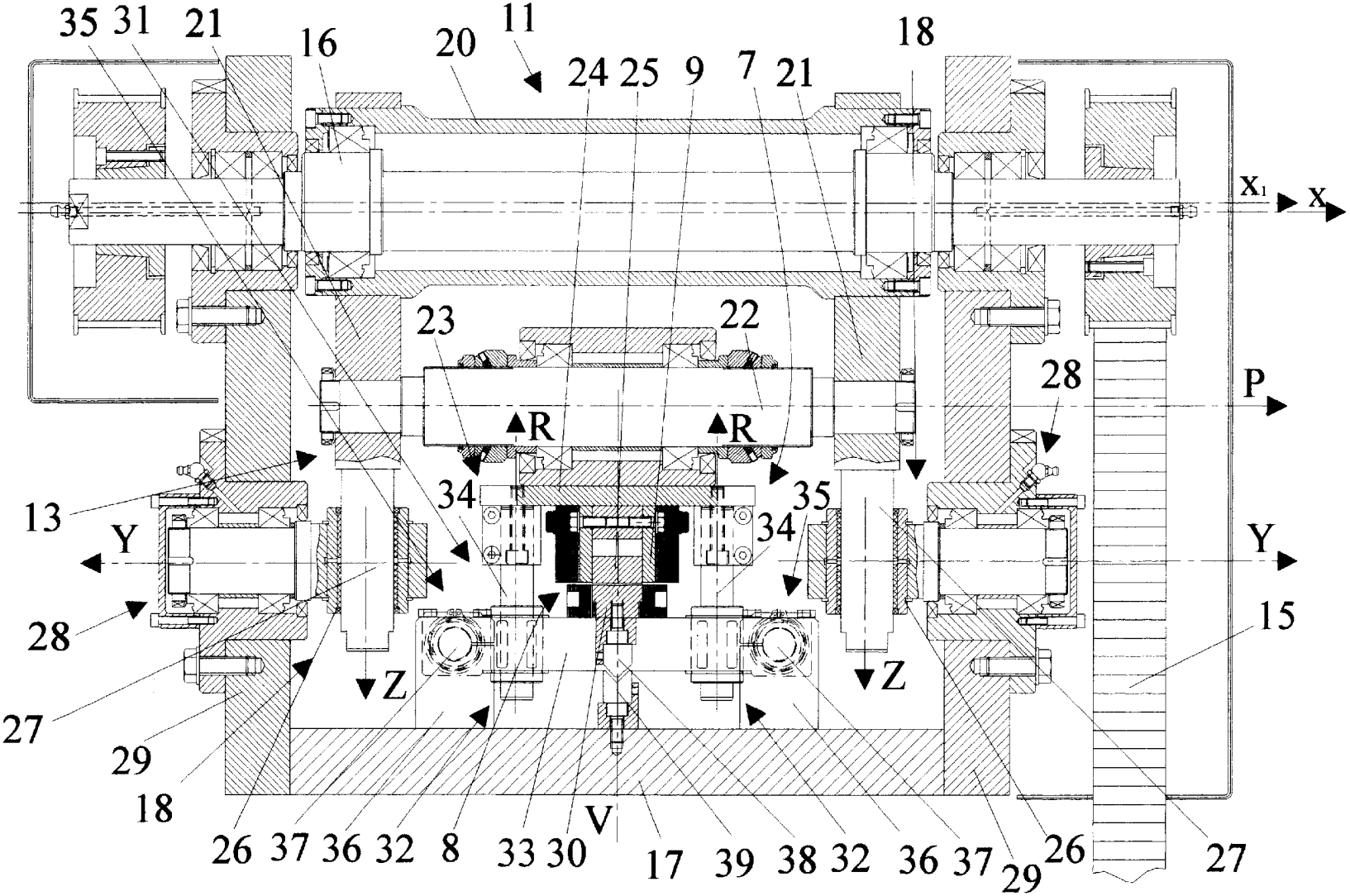
FIG. 3 shows in schematic form a cross-sectional view of the machine in question along the line III—III of FIG. 2.

With particular reference to FIG. 3, the connecting means 18 mentioned above comprise two first guides 26 inside which two corresponding arms 27 are free to slide along their respective axes Z.

These arms 27 form part of the transmission and support structure 13 since they represent an extension of the bottom end sections of the columns 21.

The two first guides 26 are left free to rotate about an axis Y by two hinges 28 mounted on the machine body 17 in the region of two lateral uprights 29.

The machine in question also comprises a counter-knife 30 which is operationally associated with the forming means 7 for formation of the web of the continuous mesh 12 of the lead plates.

Said counter-knife is connected both to the transmission and support structure 13 and to the machine body 17 by means of actuating means 31 designed to allow the counter-knife 30 a movement having the same component of motion as the forming pieces 7, oriented in the direction of feeding A of the continuous strip. In other words, during the incision step, the counter-knife 30 performs a movement in the direction A substantially in synchronism with the teeth 9 and therefore substantially at the same speed as the strip 10.

The actuating means 31 consist substantially of second guides 32 which are mounted on a base 33 integral with the counter-knife 30 and inside which corresponding rods 34 integral with the frame 23 travel in a direction R so as to allow relative sliding of the forming means 7 and the counter-knife 30. The abovementioned actuating means 31 also comprise third guides 35 which are able to allow relative sliding of the machine body 17 and the base 33 in a direction S substantially perpendicular to the direction R. These third guides 35 are mounted on shoulders 36 integral with the machine body 17 and are operationally associated with rods 37 integral with the base 33 which allow the counter-knife 30 to travel in the direction S of the third guides 35.

In the example shown in the accompanying figures, the direction R is vertical and is parallel to the direction of incision B, while the direction S is horizontal and is parallel to the direction A of feeding of the strip 10. During the operational step of incision, the rods 34 guide the base 33 and hence the counter-knife along the third guides 35 which keep the base 33 always at the same level with respect to the machine body 17, allowing in fact translation of the transmission and support structure 13 with respect to the base 33.

The base 33 also has, fixed on it in a central position, a slide 38 engaging on a fourth guide 39 integral with the machine body 17 and having the purpose of leading in a guided and precise manner the counter-knife 30 in the direction of feeding A of the strip 10.

The kinematic movement of the teeth 9 depends substantially on the motion of the cam 16, on the position of the forming means 7 with respect to the transmission and support structure 13 and on the position of the connecting means 18 which connect the transmission and support structure 13 to the machine body 17.

Figure 5A:
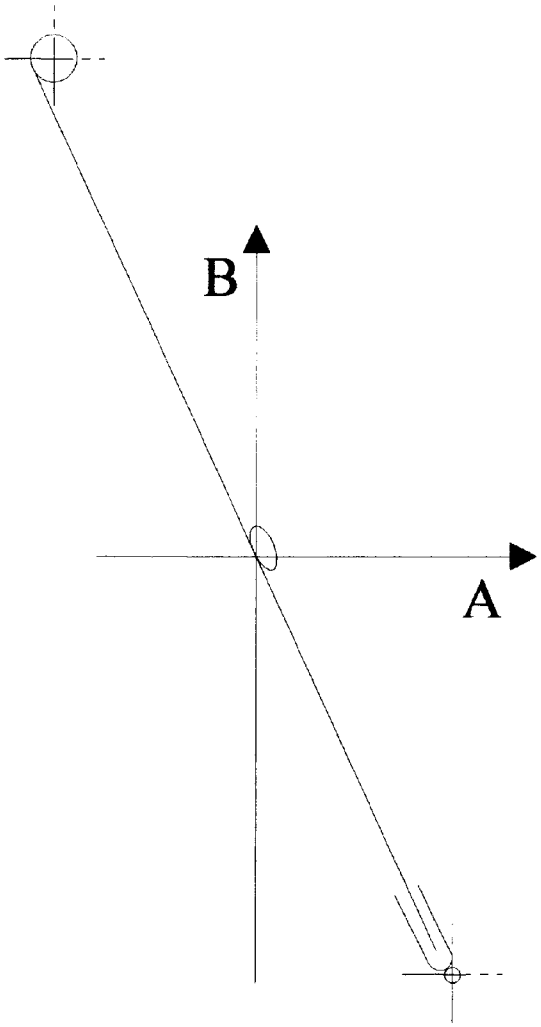
FIG. 5*a* shows the pattern of a possible law of motion of the teeth responsible for incision and expansion of the strip.

FIG. 5*a* shows, purely by way of a non-limiting example, a possible law of motion of the teeth 9.

It has an elliptical pattern with the main diameter E inclined at an angle M (see FIG. 5*b*) of between 66 and 76 degrees.

FIG. 5*b* shows in schematic form the kinematic movement corresponding to the abovementioned law of motion which allows the rotary movement of the motor 14 to be converted into a movement with an elliptical trajectory of the teeth 9.

This kinematic movement has been designed so that the horizontal component of feeding of the teeth 9 diverges from the horizontal feeding of the strip 10 (direction of feeding A), along the whole of the section where they interact with one another (i.e. during the incision step), by an amount which does not exceed a relative sliding value which may damage the strip.

In other words, it has been attempted to produce a law of motion which allows one to obtain, for the same depth of incision, a horizontal component of feeding of the teeth 9 which is substantially equal to the feeding movement of the strip 10.

As a result of the actuating means 31, the counter-knife 30 has also been provided with the same horizontal component as the forming means 7, while its vertical component follows a path along appropriate second guides 32.

What is claimed:

1. A forming machine for forming a lead strip into a mesh adapted for electric batteries the lead strip moving substantially continuously in a direction of motion thereof; the machine comprising:

moving means (2,3) designed to convey a continuous strip (10) through an incision zone (8);

forming means (7) associated with said incision zones (8) and provided with a plurality of teeth (9) which are operationally actuated by actuator means (11) so as to make incisions in said strip (10) and form a continuous mesh (12), wherein said actuator means (11) move said forming means (7) in accordance with a law of motion having:

at least one component oriented in the direction of feeding (A) of said strip (10) so as to allow said teeth (9) to advance substantially in synchronism with said strip (10) during an incision step of the machine (1);

at least one component oriented in a direction (B) substantially perpendicular to said direction of feeding (A) of said continuous strip (10) so as to allow said teeth (9) to make incisions in and expand said continuous strip (10) during said incision step of the machine (1);

said strip (10) being fed in a continuous manner by said moving means (2,3);

whereby the teeth (9) are driven in a path generally described by an ellipse having a major axis (E) inclined by an acute angle (M) to the direction of motion of the strip and to a plane of the lead strip.

2. The machine as claimed in claim 1, wherein said actuator means (11) comprise at least one motor (14) actuating a cam (16) able to transmit the movement to a transmission and support structure (13) supporting said forming means (7) and connected to the machine body (7) by means of connecting means (18) designed to allow said forming means (7) to produce said law of movement.

3. The machine as claimed in claim 2, wherein said connecting means (18) comprise at least one first guide (26) which is capable of cooperating in a sliding relationship along an axis (Z) with at least one arm (27) connected to said transmission and support structure (13), said first guide (26) being pivotably hinged with the machine body (17) and thus being free to rotate about a substantially horizontal axis (Y).

4. The machine as claimed in claim 3, wherein said arms (27) are mounted on said transmission and support structure (13) by way of an extension of said columns (21).

5. The machine as claimed in claim 2, wherein said motor (14) causes rotation, about an axis (X), of said cam (16) engaging on a collar (20) so as to cause it to rotate about an axis ($X_1$), said collar (20) being rigidly connected to said forming means (7) by means of said transmission and support structure (13).

6. The machine as claimed in claim 2, wherein said transmission and support structure (13) comprises at least two columns (21) between which there is fixed a second shaft (22) rotatably supporting about its axis (P) a frame (23) on which said said forming means (7) are mounted.

7. The machine as claimed in claim 6, wherein the two columns (21) are tilted from the plane of the lead strip.

8. The machine as claimed in claim 2, comprising a counter-knife (30) operationally associated with said forming means (7) and connected to said transmission and support structure (13) and to said machine body (17) by means of actuating means (31) designed to allow said counter-knife (30) to perform a movement having the same component as the law of motion of said forming means (7), oriented in the direction of feeding (A) of said strip (10), said counter-knife (30) thereby being displaced in said direction (A) substantially in synchronism with said teeth (9) and therefore substantially at the same speed as said strip (10).

9. The machine as claimed in claim 8, wherein said actuating means (31) comprise: at least one second guide (32) capable of allowing relative sliding of said forming means (7) and a base (33) integral with said counter-knife (30) in a direction (R); and at least one third guide (33) capable of allowing relative sliding of said machine body (17) and said base (33) in a direction (S) substantially perpendicular to said direction (R); said second guide (32) being associated with sliding means (34) designed to move said base (33) and hence said counter-knife (30) along said third guide (35).

10. The machine as claimed in claim 7, comprising at least one fourth guide (39) which is mounted integral on the machine body (17) in a substantially central position with respect to said base (33) and at least one slide (38) which is mounted integrally on said base (33) engaging on said fourth guide (38) so as to guide with precision the base (33) itself, and therefore said counter-knife (30), along said component of motion oriented in the direction of feeding (A) of said strip (10).

11. The machine as claimed in claim 1, wherein said direction (R) is vertical and is parallel to said direction (B) and wherein said direction (S) is horizontal and is parallel to said direction (A).

12. The machine as claimed in claim 1, wherein said law of motion is determined substantially by the movement of said cam (16), by the position of said forming means (7) with respect to said transmission and support structure (13) and by the position of said connecting means (18) with respect to the machine body (17).

13. The machine as claimed in claim 1, wherein it is operationally inserted within a production line of a single production assembly (6) for the manufacture of plates for electric accumulators comprising at least one grid leveling group (4) and at least one lug cutting group (5).

14. The machine as claimed in claim 1, wherein it is operationally arranged between a feeding group (2) arranged upstream and a traction group (3) arranged downstream.

15. The machine as claimed in claim 1, wherein the acute angle is approximately between 66 and 76 degrees.

16. The machine as claimed in claim 1, wherein the major axis (E) is tilted, away from a perpendicular to the direction of motion, oppositely to the direction of motion.

* * * * *